US007694375B2

(12) United States Patent
Twedt

(10) Patent No.: US 7,694,375 B2
(45) Date of Patent: Apr. 13, 2010

(54) PORTABLE CURB RAMP

(76) Inventor: Stephen O. Twedt, 645 S. 147th Pl., Burien, WA (US) 98168

( * ) Notice: Subject to any disclaimer, the term of this patent is extended or adjusted under 35 U.S.C. 154(b) by 0 days.

(21) Appl. No.: 11/479,966

(22) Filed: Jun. 29, 2006

(65) Prior Publication Data

US 2008/0003086 A1 Jan. 3, 2008

(51) Int. Cl.
*E01D 1/00* (2006.01)

(52) U.S. Cl. ..... 14/69.5; 414/537

(58) Field of Classification Search ..... 14/69.5; 182/127; 414/537, 463
See application file for complete search history.

(56) References Cited

U.S. PATENT DOCUMENTS 3,818,528 A * 6/1974 Petersen ..... 14/69.5
5,035,565 A * 7/1991 White ..... 414/537
5,062,174 A * 11/1991 DaSalvo ..... 14/69.5
5,277,436 A * 1/1994 Frank et al. ..... 280/5.2
5,505,580 A * 4/1996 Alstad et al. ..... 414/499
5,681,140 A * 10/1997 Christenson ..... 414/525.6
6,887,028 B1 * 5/2005 Kirla, Jr. ..... 414/537
7,258,384 B2 * 8/2007 Drabik et al. ..... 296/61
2007/0196201 A1 * 8/2007 Kennedy ..... 414/537

* cited by examiner

*Primary Examiner*—Saúl J Rodríguez
*Assistant Examiner*—Joshua I Rudawitz
(74) *Attorney, Agent, or Firm*—Seed Intellectual Property Law Group PLLC

(57) ABSTRACT

Apparatuses, systems, and methods for transporting objects are shown and described. Embodiments of the present invention allow objects to be easily transported over elevated structures. The disclosed embodiments can be used for quickly and conveniently traversing one or more elevated structures, such as street curbs. The disclosed embodiments can be associated with a garbage truck and used to conveniently transport dumpsters over street curbs.

11 Claims, 8 Drawing Sheets

PORTABLE CURB RAMP

BACKGROUND OF THE INVENTION

1. Field of the Invention

The invention relates to apparatuses, systems, and methods for transporting objects. More particularly, the invention relates to curb ramp systems having at least one portable curb ramp for use with wheeled objects.

2. Description of the Related Art

Proper collection, containment, transportation, and disposal of waste are important for protecting public health and maintaining a clean environment. Refuse receptacles for collecting waste are often kept at residential sites and commercial sites. Dumpsters are one type of refuse receptacle often used to hold large quantities of solid waste. Dumpsters may be used at multifamily residential, institutional, commercial, industrial, and construction sites due to the large amount of waste generated at these locations.

Garbage trucks are used to empty dumpsters. To empty a dumpster into a garbage truck, the dumpster is moved from a collection site onto a roadway where the garbage truck is located. The dumpster can then be wheeled on the roadway towards the garbage truck. Once the dumpster is in the proper position, the contents of the dumpster are discharged into a collection container of the garbage truck. The empty dumpster may be returned to its collection site.

Unfortunately, a street curb may be located between the collection site and garbage truck. Thus, the dumpster may have to be lifted vertically and carried over the curb. For example, the partially or completely filled dumpster may have to be carried above the curb towards the garbage truck. After the dumpster is emptied into the garbage truck, the dumpster may again be lifted and carried over the curb in order to return the dumpster to the collection site. Thus, transporting the dumpster to and from the truck may be difficult. If the dumpster is heavy, two or more people may be required for properly transporting the dumpster.

Different types of dumpsters can be used based on the amount of waste generated at a particular location. A front load dumpster is often used at multifamily residential and light commercial sites. A front load dumpster often has a pair of sleeves fixed to opposing side walls of the dumpster. Each sleeve is configured to receive a lifting arm of a front loading garbage truck. To empty the front load dumpster into the truck, the lifting arms are positioned within corresponding sleeves of the dumpster. The driver then activates a hydraulic system which lifts the lifting arms and associated dumpster over the cabin of the truck. The hydraulic system then rotates the dumpster to an upside down position to transfer waste from the dumpster to a larger collection container or hopper at the back of the truck. The driver then lowers the emptied dumpster and withdraws the lifting arms from the sleeves. The driver may then activate a compactor to compact the waste within the hopper, thereby increasing the amount of solid waste that the hopper can accommodate. The front loading garbage truck then travels to the location of the next front load dumpster to repeat the procedure until the hopper is full. Once the hopper is full, the front loading garbage truck travels to a disposal site, such as a landfill, to dispose of the waste.

A rear load dumpster is often larger than a front load dumpster. These types of dumpsters are often used at heavy commercial, industrial, and construction sites. To empty the rear load dumpster, the dumpster is pulled onto the bed of a truck, such as a roll-off truck, and transported to the disposal site. A typical roll-off truck is equipped with a winch and roller system which positions the dumpster onto the bed of the truck for transportation to the disposal site. At the disposal site, the bed and dumpster are tilted so that the waste is discharged through one or more rear doors provided at the end of the dumpster. After being emptied, the rear load dumpster is often returned to the same or a different refuse collection site.

To empty the contents of a dumpster (e.g., a rear or front load dumpster), the dumpster may have to traverse a curb or other structure. The filled dumpster may be relatively heavy and, consequently, difficult to transport over the curb.

BRIEF SUMMARY OF THE INVENTION

The present invention is generally directed towards apparatuses, systems, and methods for transporting objects. In particular, embodiments of the present invention allow objects to be easily transported up, down, and/or over elevated structures, such as curbs, speed bumps, stairs, and the like. For example, wheeled objects can be transported up and down the elevated structures. The wheeled objects (e.g., trash or refuse receptacles, dumpsters, dolley carts, furniture/appliances with casters, and the like) can be easily rolled up onto and/or off of a curb. Accordingly, the disclosed embodiments can be used for quickly and conveniently traversing one or more elevated structures.

In some embodiments, a system for transporting a dumpster comprises a garbage truck, a mounting system, and at least one curb ramp. The garbage truck has a lift system for receiving and lifting a dumpster so as to empty contents of the dumpster into a collection container of the garbage truck. The mounting system is coupled to the garbage truck. The at least one curb ramp is configured to be releasably coupled to the mounting system. The at least one curb ramp is dimensioned for placement on a curb and a roadway to define a ramp surface suitable for supporting at least one wheel of the dumpster when the at least one curb ramp is decoupled and separated from the mounting system.

In other embodiments, a system for transporting a dumpster comprises a mounting system configured to be coupled to a garbage truck and a plurality of ramps. The plurality of ramps is configured to be removably coupled to the mounting system when the mounting system is coupled to a garbage truck. Each ramp is dimensioned for placement on a curb and a roadway to define a ramp surface suitable for supporting at least one wheel of the dumpster when the plurality of ramps are separated from the mounting system.

In some embodiments, a curb ramp comprises a main ramp body having an upper surface and a lower surface. The upper surface and lower surface extend between a first lateral side and an opposing second lateral side of the main ramp body. A curb mounting portion is configured to rest upon an upper surface of a curb. A roadway mounting portion is configured to rest upon a surface of a roadway. The main ramp body extends between the roadway mounting portion and the curb mounting portion. A first sidewall and a second sidewall is coupled to the first and second lateral sides, respectively. The first sidewall and the second sidewall are spaced laterally apart from each other to accommodate a wheel. At least one ramp mounting structure is configured for releasably coupling to a mounting structure of a vehicle.

In yet other embodiments, a method of using a ramp comprises separating a ramp from a mounting system of a garbage truck. A curb mounting portion of the ramp is placed on a curb and an opposing supporting portion of the ramp on a roadway such that the ramp defines a ramp surface. A dumpster is moved onto and over the ramp surface so as to traverse the curb.

DETAILED DESCRIPTION OF THE INVENTION

The present detailed description is generally directed towards systems, apparatuses, and methods for moving objects, such as wheeled objects. Several embodiments of the present invention may aid one or more individuals in transporting one or more wheeled objects up, down, and/or over a curb. Many specific details of certain embodiments of the invention are set forth in the following description and in FIGS. 1-15 to provide a thorough understanding of such embodiments. One skilled in the art, however, will understand that the present invention may have additional embodiments or may be practiced without one or more of the details described in the following description.

Figure 1:
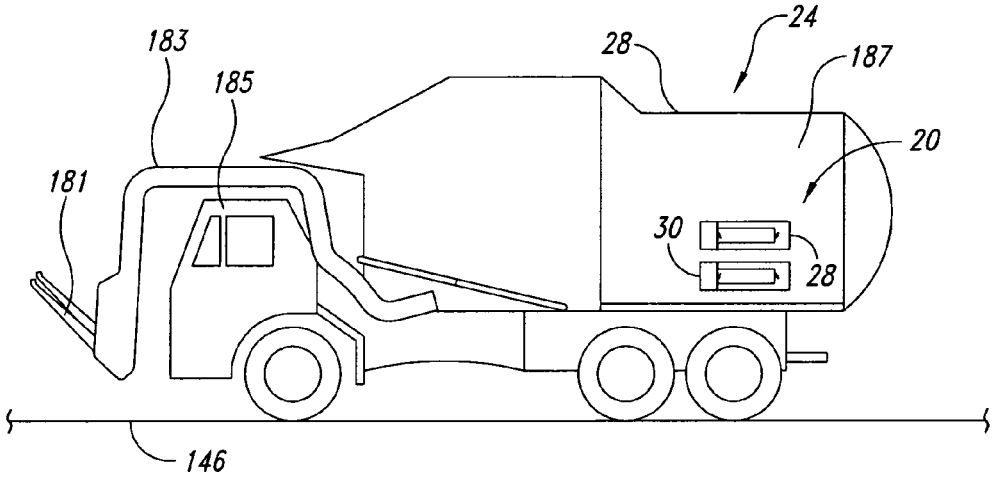
FIG. 1 is a side elevational view of a truck having a curb ramp system according to one embodiment of the present invention.

FIG. 1 illustrates a curb ramp system 20 that is removably coupled to a vehicle 24. The curb ramp system 20 includes a pair of portable curb ramps 28, 30, which can be manually removed from the vehicle 24 and used to traverse a curb. For example, a wheeled object can traverse the curb by rolling conveniently over the curb ramps 28, 30. The ramps 28, 30 can then be re-coupled to the vehicle 24 for subsequent transport. Thus, the ramps 28, 30 aid in transporting an object to and/or from the vehicle 24.

The portable ramps 28, 30 can be generally similar to each other and, accordingly, the following description of one of the ramps applies equally to the other, unless indicated otherwise. As used herein, the term "portable" is a broad term that includes, without limitation, reference to components of the curb ramp system 20 which can be readily carried or transported by a person. For example, a person can manually transport one or both of the portable ramps 28, 30.

Figure 2:
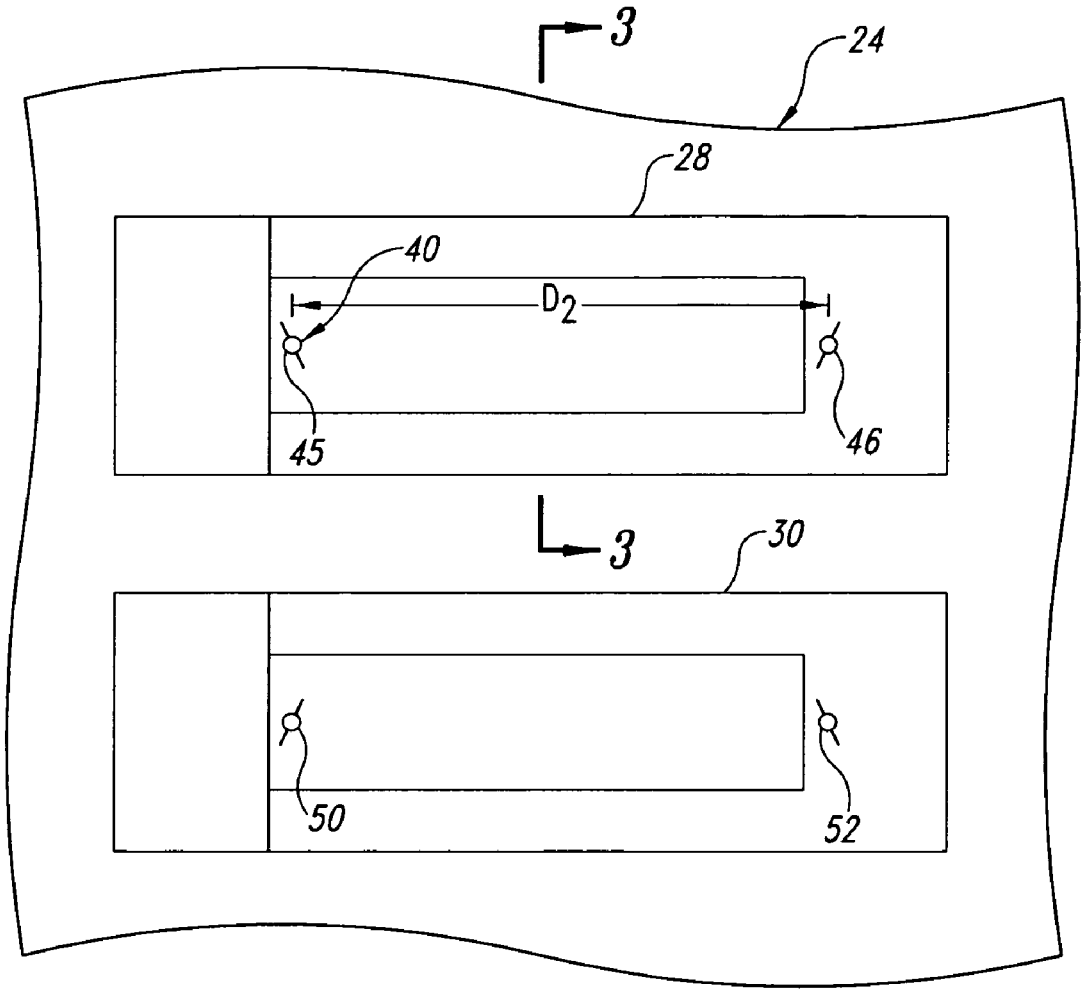
FIG. 2 is a side elevational view of the curb ramp system of FIG. 1.

As shown in FIG. 2, the ramps 28, 30 can be mounted to the vehicle 24 via a mounting system 40. The mounting system 40 can securely hold the ramps 28, 30 on the vehicle 24 during normal use and operation of the vehicle 24. Accordingly, the ramps 28, 30 remain coupled to the truck 24 when the truck 24 travels between collection sites, waste disposal sites, and the like. When desired, the mounting system 40 selectively allows removal of one or both of the ramps 28, 30.

The illustrated mounting system 40 includes an upper pair of mounting members 45, 46 and a lower pair of mounting members 50, 52. The upper pair of mounting members 45, 46 is configured to receive and hold the horizontally oriented ramp 28. The lower pair of mounting members 50, 52 is configured to receive and hold the horizontally oriented ramp 30.

Figure 3:
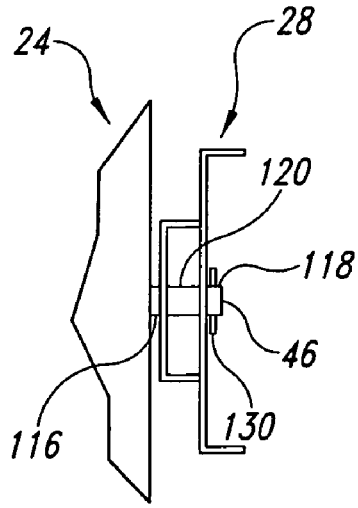
FIG. 3 is a cross-sectional view of a portable curb ramp taken along a line 3-3 of FIG. 2.

The upper pair of mounting members 45, 46 and the lower pair of mounting members 50, 52 can extend through the ramps 28, 30, respectively. As shown in FIG. 3, for example, the mounting member 46 extends through and protrudes from the ramp 28. Each of the ramps 28, 30 preferably remains coupled to the mounting system 40 during normal driving conditions. The mounting members 45, 46, 50, 52 can be generally similar to each other and, accordingly, the following description of one of the mounting members applies equally to the others, unless indicated otherwise.

The ramp systems described herein can be used with various types of vehicles. As used herein, the term "vehicle" is a broad term that includes, but is not limited to, trucks (e.g., garbage trucks, dump trucks, moving trucks, roll-off trucks, pick-up trucks, etc.), semis with or without semi trailers, automobiles, and other vehicles used to transport objects. The illustrated vehicle 24 is a garbage truck. In other embodiments, the ramp system 20 is coupled to other types of vehicles, such as a moving trucks or trailer. For example, the ramp system 20 can be removably coupled to an interior surface of a holding container of a moving truck. For the sake of convenience, the curb ramp systems described herein are discussed primarily in conjunction with garbage trucks.

As used herein, the term "garbage truck" is a broad term and includes, but is not limited to, a truck specially designed to haul a large load. The load can include, but is not limited to, waste, trash, or other materials or items. Garbage trucks can take a load to a disposal/recycling facility. The garbage truck can be, without limitation, a front load garbage truck, rear load garbage truck, side load garbage truck, pneumatic collection garbage truck, or any other suitable garbage truck for receiving and transporting the load. In some embodiments, the garbage truck has a lifting system (e.g., a mechanical lifting system, hydraulic lifting systems, etc.) that can receive a dumpster. After the lifting system receives a dumpster, the garbage truck can lift and empty the contents of the dumpster into a collection container of the garbage truck. In some embodiments, the garbage truck has a collection container with a capacity of at least about one cubic yard. These types of garbage trucks are especially well suited for routes having at least one dumpster with casters. In other embodiments, the garbage truck has a collection container having a capacity of at least two cubic yards. In other embodiments, the collection container of the garbage truck has a capacity of about four cubic yards, five cubic yards, six cubic yards, and ranges encompassing such capacities. In yet other embodiments, the garbage truck has the capacity of at least about ten cubic yards, twelve cubic yards, or fourteen cubic yards. Of course, the holding capacity of the garbage truck can be selected based on the amount of material to be transported.

Figure 4:
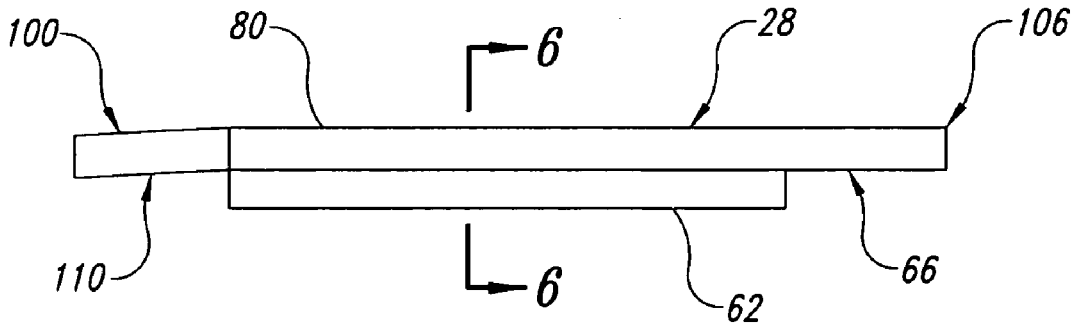
FIG. 4 is a side elevational view of a portable curb ramp according to one embodiment of the present invention.
Figure 5:
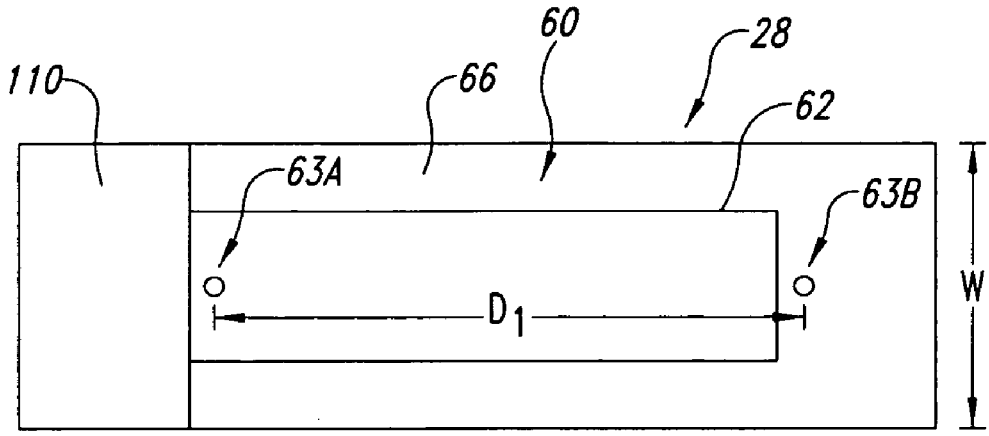
FIG. 5 is a bottom plan view of the curb ramp of FIG. 4.
Figure 6:
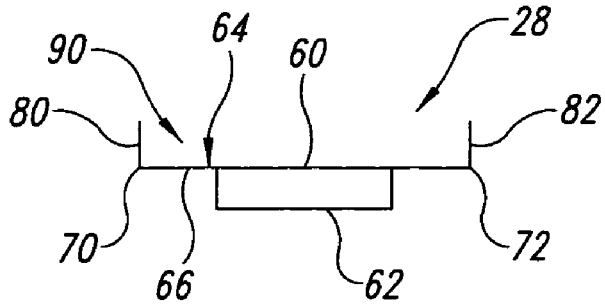
FIG. 6 is a cross-sectional view of the curb ramp of FIG. 4 taken along line 6-6.

FIGS. 4 to 6 illustrate the curb ramp 28 including a main ramp body 60 having an upper or support surface 64 and a lower surface 66. A stiffener 62 extends longitudinally along a central portion of the main body 60. A pair of ramp mounting structures 63A, 63B is configured to engage the mounting system 40. The upper and lower surfaces 64, 66 extend laterally between a first lateral side 70 and an opposing second lateral side 72.

As shown in FIG. 6, first and second sidewalls 80,82 extend vertically from the first lateral side 70 and second lateral side 72, respectively. The first sidewall 80 and second sidewall 82 are spaced laterally apart from each other a sufficient distance to accommodate a wheel. In some embodiments, including the illustrated embodiment, the sidewalls 80, 82 cooperate with the upper surface 64 to define a ramp channel 90 dimensioned to accommodate at least one wheel or caster assembly of a dumpster. For example, the first and second sidewalls 80, 82 can define a width of at least about 6 inches (15 cm). In some embodiments, the first and second sidewalls 80, 82 can define the width in the range of about 8 inches (20 cm) to about 12 inches (30 cm). The illustrated ramp 28 has a width W of about 12 inches (30 cm). The sidewalls 80, 82 can laterally constrain a wheel while providing enough room for effectively maneuvering a dumpster wheel, thus facilitating transport of a wheeled dumpster across the ramp 28. The sidewalls 80, 82 are preferably sufficiently high so as to effectively prevent a wheel from rolling thereover. In some embodiments, the sidewalls 80, 82 have a height of at least about 0.5 inches (1.3 cm), 1 inch (2.5 cm), or 1.5 inches (3.8 cm).

With reference again to FIGS. 4 and 5, the curb ramp 28 preferably includes a curb mounting portion 100 configured to rest upon an upper surface of a curb. An opposing roadway mounting portion 106 is configured to rest upon a surface of a roadway. In the illustrated embodiment, the curb mounting portion 100 can be angled with respect to the main ramp body 60. As such, a lower surface 110 of the curb mounting portion 100 can lay on an upper surface of the curb while the main ramp body 60 extends downwardly such that the roadway mounting portion 106 rests securely on the roadway.

The stiffener 62 can be interposed between the curb mounting portion 100 and roadway mounting portion 106. In the illustrated embodiment, the stiffener 62 extends from a location proximate to the curb mounting portion 100 to a location proximate to the roadway mounting portion 106. However, the stiffener 62 can be at other suitable locations. The position and orientation of the stiffener 62 can be selected to achieve the desired structural properties of the ramp 28.

The illustrated stiffener 62 of FIG. 6 is a generally U-shaped member attached to the lower surface 66 of the main ramp body 60, although the stiffener 62 can have any other suitable shape. Additionally or alternatively, the stiffener 62 can comprise one or more reinforcement or stiffening members (e.g., ribs, beams, etc.), thickened portions, or other suitable structures for affecting the rigidity of the ramp 28.

Each of the ramp mounting structures 63A, 63B of FIG. 2 can be an aperture sized to receive the mounting members 45, 46, respectively. The illustrated ramp mounting structure 63A is an aperture extending through the stiffener 62 and main body 60. The ramp mounting structure 63B is positioned between the stiffener 62 and roadway mounting portion 106 and extends through the main body 60. The ramp mounting structures 63A, 63B can also be at other locations. For example, the ramp mounting structure 63A can extend through the curb mounting portion 100, and the ramp mounting portion 63B can extend through the stiffener 62 and main body 60.

The illustrated ramp mounting structures 63A, 63B are separated by a distance D1. The mounting structures 45, 46 of FIG. 2 are separated by a distance D2. The distance D1 can be generally equal to the distance D2 such that the mounting members 45, 46 can be aligned and passed through the mounting structures 63A, 63B, respectively.

Any number of mounting structures and ramp mounting structures can be used. In some embodiments, for example, the ramp 28 has a single aperture for engaging a single mounting bracket on the truck 24.

The ramp 28 is preferably sufficiently rigid to support at least one wheel of a dumpster when the dumpster is at least partially or completely filled with waste. In some embodiments, the ramp 28 is configured to support at least 500 lbs (2224 N). In some embodiments, the ramp 28 is configured to support at least 1,000 lbs (4448 N). In other embodiments, the ramp 28 is configured to support at least 1,500 lbs (6672 N). In yet other embodiments, the ramp 28 is configured to support at least 2,000 lbs (8896 N). In such embodiments, at least one wheel of a dumpster can be supported by the ramp 28 even when the dumpster and waste contained therein has a combined weight of about 8,000 lbs (3629 kg).

The portable ramp 28 can comprise a somewhat lightweight and strong material, such as aluminum. An aluminum sheet having a thickness of about 0.125 inches (0.318 cm) can be cut and shaped in the form of the ramp 28. In such embodiments, the ramp 28 can advantageously be generally corrosion resistant for a prolonged useful life, especially if the ramp 28 is mounted to the exterior of the truck 24. The ramp 28 can also be constructed from other types of metals (e.g., steel, titanium, etc.) and other materials with suitable characteristics such as wood, plastics, composite materials, and the like. One of ordinary skill in the art can select the appropriate material type, thickness, and ramp configuration to achieve the desired structural properties of the ramp. The ramp 28 can be relatively lightweight for convenient manual (e.g., handheld) transport to and from the garbage truck 24. In non-limiting exemplary embodiments, the ramp 28 can weigh less than about 40 lbs, 30 lbs, 20 lbs, or 10 lbs. In non-limiting exemplary embodiments, the ramp 28 can have a mass less than about 18 kg, 14 kg, 9 kg, or 5 lbs.

With reference again to FIGS. 2 and 3, the mounting members 45, 46, 50, 52 can be generally similar to each other and, accordingly, the following description of one of the mounting members applies equally to the others, unless indicated otherwise. The mounting member 46 is an elongated mounting bracket extending outwardly from the garbage truck 24, and preferably includes a mounting portion 116, a tip 118, and a mounting member main body 120 extending therebetween.

The mounting portion 116 can be coupled to an exterior surface of the garbage truck 24. In some embodiments, the mounting portion 116 is welded, fused, and/or bonded to the garbage truck 24. In other embodiments, the mounting portion 116 is threadably coupled to the garbage truck 24. For example, external threads of the mounting portion 116 can threadably mate with corresponding internal threads of a hole in the garbage truck 24. It is contemplated that the mounting member 46 can be permanently or temporarily coupled to the garbage truck 24.

The tip 118 of the mounting member 46 can be configured to inhibit or substantially prevent the ramp 28 from inadvertently sliding off of the mounting member 46. An optional fastener 130 (e.g., a pin, rod, cotter pin, etc.) can be removably coupled to the tip 118. The illustrated fastener 130 extends through a through hole in the tip 118.

Additionally or alternatively, at least a portion of the mounting member 46 can be angled upwardly. The tip 118 can extend upwardly from the main body 120. The ramp 28 can be captured between the garbage truck 24 and upwardly extending tip 118. To remove the ramp 28 from the mounting member 46, the ramp 28 can be rotated and lifted upwardly off of the tip 118. In some embodiments, the entire mounting member 46 extends upwardly and outwardly from the garbage truck 24 such that the ramp 28 rests near or at the junction of the garbage truck 24 and mounting member 46.

In one method of using the ramp system 20, a user can manually remove the ramps 28, 30 from the garbage truck 24. The ramp system 20 is preferably positioned along the garbage truck 24 such that the user can conveniently access and remove the ramps 28, 30 from the garbage truck 24. In the illustrated embodiment of FIG. 1, a user standing on a roadway 146 can quickly remove and separate one or both of the ramps 28, 30 from the mounting system 40.

Figure 7:
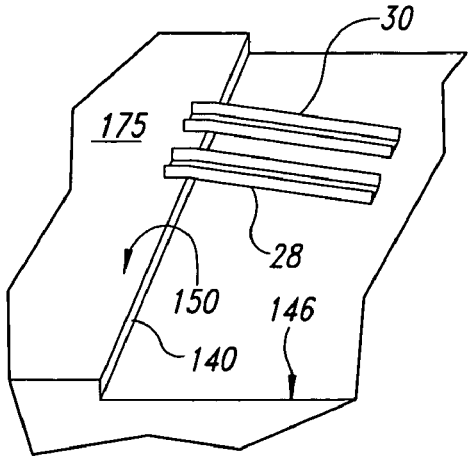
FIG. 7 is a perspective view of a pair of curb ramps positioned along a curb.

The ramps 28, 30 are carried away from the garbage truck 24 and are placed upon a curb 140. As shown in FIG. 7, the spacing between the ramps 28, 30 can generally correspond to the spacing between the opposing wheels of the dumpster 170. Of course, the distance between the ramps 28, 30 can be adjusted or selected based on the distance between the wheels of the objects traveling across the ramps 28, 30. Advantageously, various types of dumpsters with casters can be rolled across the ramps 28, 30 without having to manually lift the dumpsters into the air.

Figure 8:
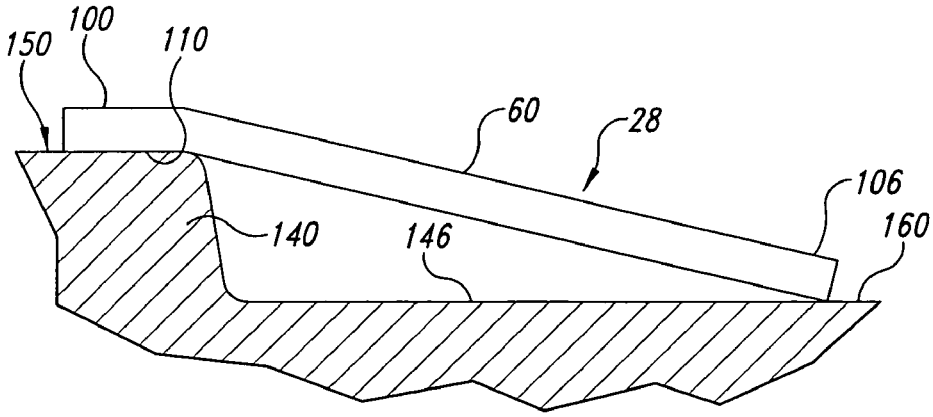
FIG. 8 is a side elevational view of one of the portable curb ramps of FIG. 7.
Figure 9:
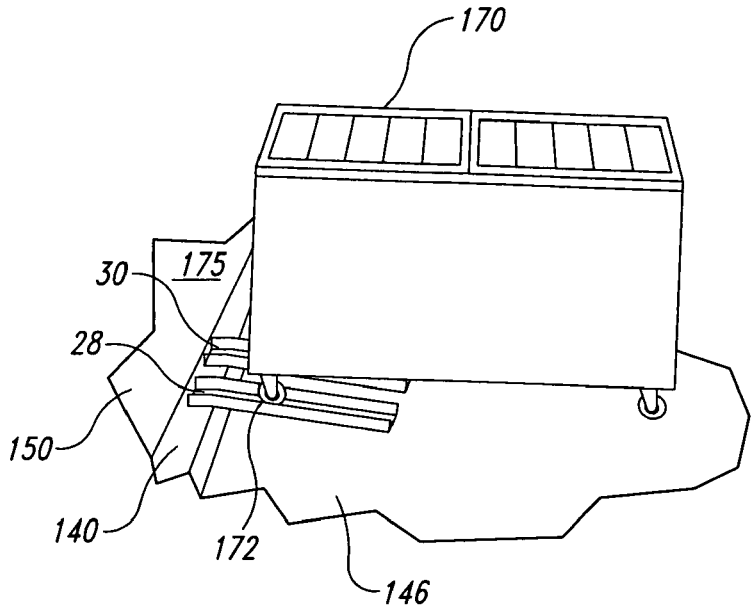
FIG. 9 is a perspective view of a wheeled object positioned on the curb ramps of FIG. 7.

The curb mounting portion 100 preferably rests securely on the upper surface 150 of the curb 140. As shown in FIG. 8, the main ramp body 60 extends downwardly from the curb mounting portion 100 to the roadway mounting portion 106 which rests on an upper surface 160 of the roadway 146. The illustrated curb 140 has a height of at least 3 inches (8 cm), 4 inches (10 cm), or 6 inches (15 cm).

After positioning the ramps 28, 30 on the curb 140, the dumpster 170 can be easily wheeled along an elevated surface 150 from a collection site 175 (FIG. 7) towards the ramps 28, 30. The dumpster 170 is then rolled downwardly across the ramps 28, 30 and onto the roadway 146. The ramps 28, 30 can be spaced from the garbage truck 24 to allow maneuvering of the dumpster 170 on a portion of the roadway 146 extending between the ramps 28, 30 and garbage truck 24. In some embodiments, for example, at least one of the curb ramps 28, 30 and parked garbage truck 24 are separated by a distance greater than about 3 feet. In some embodiments, at least one of the curb ramps 28, 30 and garbage truck 24 are separated by a distance greater than the width of the wheel base of the dumpster 170.

Once the dumpster 170 is on the roadway 146, the dumpster 170 can be rolled across the roadway 146 and into an appropriate position relative to the garbage truck 24. Lifting arms 181 of a lift system 183 of the front loading garbage truck 24 of FIG. 1 can engage the dumpster 170.

The lift system 183 can move the lifting arms 181 between a lowered position for receiving the dumpster 170 and an elevated position for emptying the dumpster 170. The lift system 183 preferably lifts the dumpster 170 over a cabin 185 of the truck 24 and rotates the dumpster 170 to an upside down position, thereby empting the contents of the dumpster 170 into a collection container 187 of the truck 24. The lift system 183 then lowers the empty dumpster 170 onto the ground 146. The lift arms 180 can be removed from the dumpster 170.

One or more individuals can push the emptied dumpster 170 along the roadway 146 to the ramps 28, 30. The dumpster 170 is pushed upwardly across the ramps 28, 30 and onto the elevated surface 150. In this manner, one or more individuals can roll the dumpster 170 to and from the garbage truck 24.

The garbage truck 24 can travel to the location of the next dumpster to repeat the procedure until the waste in the collection container 187 of the truck 24 reaches a predetermined amount. The garbage truck 24 can then be emptied at a disposal site.

Figure 10:
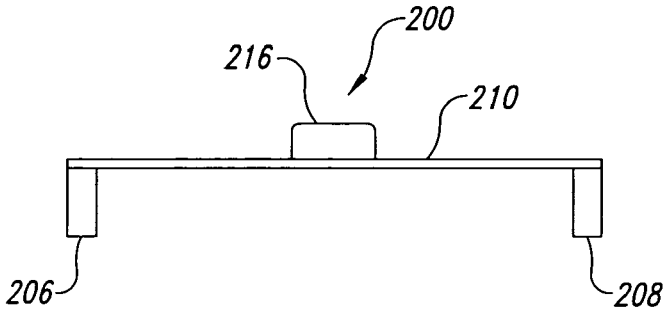
FIG. 10 is a side elevational view of an installation tool for installing a mounting system according to one embodiment.
Figure 11:
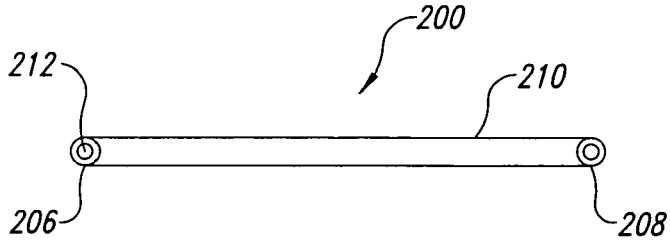
FIG. 11 is a bottom plan view of the installation tool of FIG. 10.

FIGS. 10 and 11 illustrate an installation tool 200 configured to install the mounting system 40 described above. The installation tool 200 includes a pair of holders 206, 208. Each of the holders 206, 208 is configured to removably receive one of the mounting members 45, 46, 50, 52 of the mounting system 40 while the retained mounting members 45, 46, 50, 52 are coupled to a garbage truck 24. The installation tool 200 quickly aligns and spaces the mounting members 45, 46, 50, 52 during the installation process, thereby reducing installation time and costs. Moreover, the tool 200 ensures that the installed members 45, 46, 50, 52 are properly spaced to receive the corresponding ramps 28, 30.

An installation tool body 210 can extend between the holders 206, 208 and provides proper spacing between the holders 206, 208. The body 210 preferably defines a distance between the holders 206, 208 that generally corresponds to the distance between the ramp mounting structures of the ramps 28, 30 described above. A handle 216 for conveniently grasping and holding the installation tool 200 is preferably coupled to the installation tool body 210.

As noted above, each of the holders 206, 208 is configured to removably receive at least one of the mounting members 45, 46, 50, 52. In the illustrated embodiment, each holder 206, 208 is a generally tubular member defining a passageway configured to receive at least one of the mounting members 45, 46, 50, 52.

For example, at least a portion of the mounting member 46 of FIG. 6 can be inserted through an opening 212 and into the holder 206. Similarly, at least a portion of the mounting member 45 can be inserted into the holder 208. After loading the installation tool 200 with the mounting members 45, 46, the mounting portions of the mounting members 45, 46 can be placed against the garbage truck 24. While the installation tool 200 holds the mounting members 45, 46 in a desired position, the mounting members 45, 46 are coupled to the garbage truck 24.

After installing the mounting members 45, 46, the installation tool 200 can be slid off of the mounting members 45,46 and used to install additional mounting members, as desired. For example, the installation tool 200 can be used to install the mounting members 50, 52 of FIG. 2. As such, the installation tool 200 can be used any number of times to install any number of mounting members.

It is also contemplated that the mounting system 40 can be installed without the use of the installation tool 200. An installer may visually determine the appropriate position of the mounting members 45,46, 50, 52, and after positioning the mounting members 45, 46, 50, 52, the installer can manually hold and install each of the mounting members 45, 46, 50, 52.

The illustrated mounting system 40 of FIG. 2 is designed to hold two curb ramps on the garbage truck 24. However, the mounting system 40 can be modified to hold any number of ramps on the garbage truck 24. For example, the mounting systems described herein can be modified to couple more than one portable curb ramps to a garbage truck.

Figure 12:
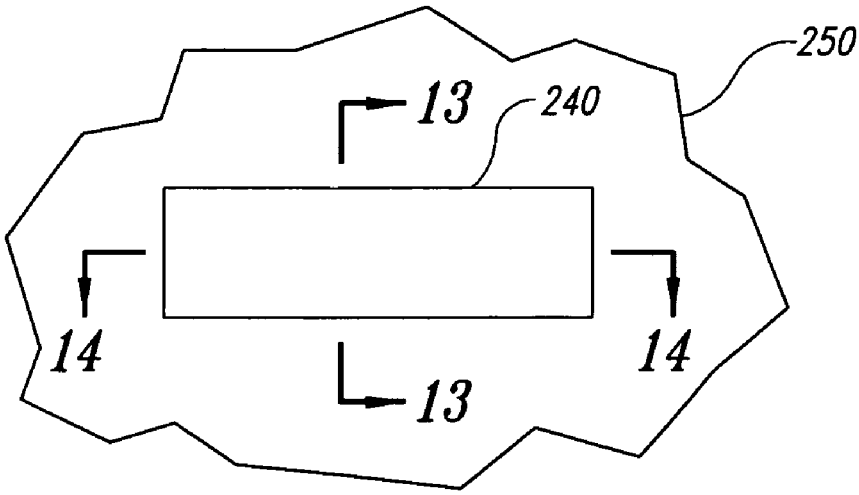
FIG. 12 is a side elevational view of a curb ramp system according to another embodiment.
Figure 13:
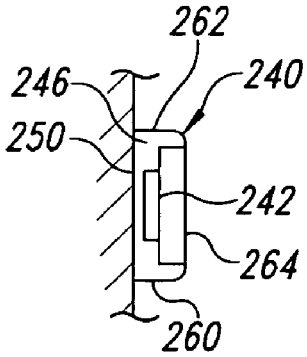
FIG. 13 is a cross-sectional view of the curb ramp system of FIG. 12 taken along a line 13-13.
Figure 14:
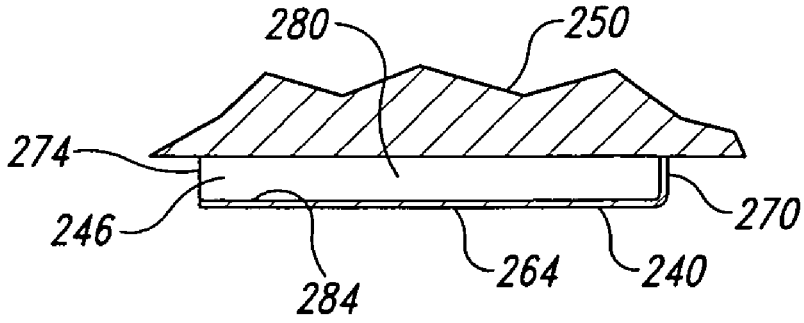
FIG. 14 is a cross-sectional view of the curb ramp system of FIG. 12 taken along a line 14-14.

FIGS. 12 to 15 depict another embodiment of a ramp system which may be generally similar to the embodiments described above, except as further detailed below. The illustrated mounting system 240 of FIGS. 12-14 is in the form of an elongate sleeve dimensioned to hold a single ramp 242.

The mounting system 240 has a lower wall 260, an upper wall 262, and a sidewall 264 extending therebetween. The lower and upper walls 260, 262 extend generally horizontally between a garbage truck 250 and upper and lower portions of the generally vertically oriented sidewall 264. As such, the illustrated mounting system 240 has a generally U-shaped profile. However, the mounting system 240 can also have other configurations. The shape and size of the mounting system 240 can be selected based on the shape, size, and number of the ramps to be contained therein. For example, the mounting system 240 can be modified to hold more than one curb ramp.

With respect to FIG. 14, the mounting system 240 can be closed ended to inhibit, limit, or substantially prevent movement of the ramp 242 in at least one direction. A front wall 270 extends between the sidewall 264 and truck 250. To position the curb ramp 242 (FIG. 13) within the mounting system 240, the ramp 242 can be inserted through an opening 274 and into a holding chamber 280 defined by the truck 250 and an inner surface 284 of the mounting system 240. The ramp 242 can also be pulled out of the mounting system 240.

Figure 15:
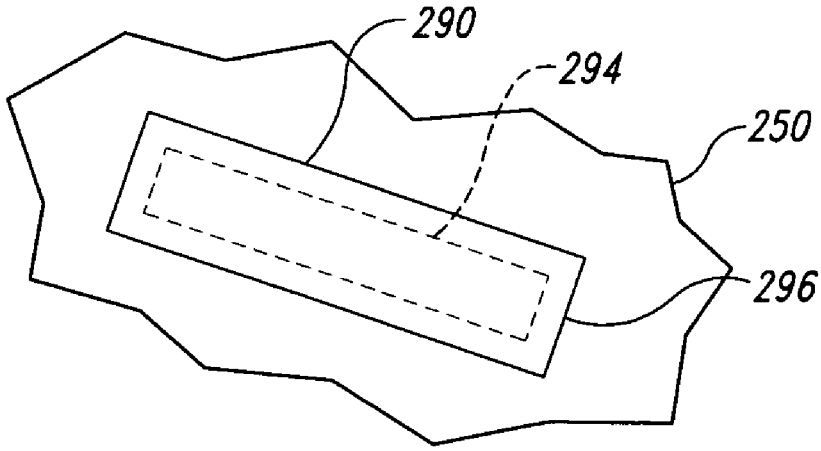
FIG. 15 is a side elevational view of a curb ramp system according to yet another embodiment.

The orientation of the sleeve-type mounting systems can be selected to inhibit or substantially prevent the ramp from sliding out of the mounting system 240. For example, a mounting system 290 of FIG. 15 is angled with respect to an imaginary horizontal plane. A ramp 294 (shown in phantom in FIG. 15) preferably rests against a front wall 296 of the mounting system 290. Gravity acting upon the ramp 294 inhibits or substantially prevents the ramp 294 from inadvertently sliding upwardly out of the mounting system 290. In other embodiments, the mounting system 290 can be oriented such that a longitudinal axis of the mounting system 290 extends generally vertically.

The sleeve-type mounting systems of FIG. 14 to FIG. 15 can also be opened at both ends. Advantageously, the ramps can be removed or inserted through either open end of the mounting systems. Stops, fasteners, ties, brackets, holders, or other suitable structures can hold one or more ramps within these mounting systems.

The articles disclosed herein may be formed through any suitable means. For example, the ramp systems can be formed through one or more machining processes, molding processes, stamping processes, combinations thereof, and the like. The various methods and techniques described above provide a number of ways to carry out the illustrative embodiments. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof.

The invention claimed is:

1. A system for transporting a dumpster, the system comprising:

a garbage truck having a collection container and a lift system for receiving and lifting a dumpster, the lift system movable with respect to the collection container between a lowered position and an elevated position, the lift system configured to receive the dumpster on a roadway when in the lowered position and configured to empty contents of the dumpster into the collection container of the garbage truck when the lift system carrying the dumpster moves to the elevated position;

a mounting system coupled to and protruding outwardly from one side of the garbage truck, the mounting system being positioned rearward of a front end of the garbage truck and positioned forward of a rear end of the collection container, the mounting system comprising a first elongate mounting member, a second elongate mounting member, a first fastener, and a second fastener, the first fastener and the second fastener extending through the first and second elongate mounting members, respectively;

at least one curb ramp configured to be releasably coupled to the mounting system, the at least one curb ramp being dimensioned for placement on a curb and the roadway to define a ramp surface suitable for supporting at least one wheel of the dumpster when the at least one curb ramp is decoupled from the mounting system and separated from the garbage truck, the curb ramp having at least two ramp mounting structures sized and configured to receive corresponding ones of the first elongate mounting member and the second elongate mounting member;

an installation structure for defining a first distance, the installation structure configured to be used when installing the first elongate mounting member and the second elongate mounting member such that the first elongate mounting member and the second elongate mounting member are spaced apart an installation distance substantially equal to the first distance while the first elongate mounting member and the second elongate mounting member are being coupled to the garbage truck, the first distance being substantially equal to a second distance between the at least two ramp mounting structures; and wherein the first and second elongate mounting members extend away from the garbage truck through the at least one curb ramp such that the at least one curb ramp is positionable between the garbage truck and the first and second fasteners, the mounting system is spaced apart from the lift system such that a user on the roadway is able to couple the at least one curb ramp to the mounting system as the lift system moves between the lowered position and the elevated position.

2. The system of claim 1 wherein the at least one curb ramp is capable of supporting a load equal to or greater than about 1,000 lbs.

3. The system of claim 1 wherein the at least one curb ramp is dimensioned to slope upwardly from the roadway to the curb such that a person is capable of wheeling the dumpster up and down the at least one curb ramp when the at least one curb ramp is placed on the curb and roadway.

4. The system of claim 1 wherein the at least one curb ramp weighs less than about 20 lbs.

5. The system of claim 1 wherein the at least one curb ramp is configured to be manually coupled to and removed from the mounting system.

6. The system of claim 1 wherein the at least one curb ramp is sufficiently rigid to support the at least one wheel of the dumpster when the dumpster is at least partially filled with material.

7. The system of claim 1 wherein the mounting system is configured to receive the at least one curb ramp such that the ramp remains coupled to the first and second elongate mounting members during normal driving conditions.

8. A transportation system for transporting a dumpster, comprising:

a vehicle including a collection container and a lift system configured to receive and lift the dumpster, the lift system movable with respect to the collection container between a lowered position and an elevated position, the lift system configured to receive the dumpster positioned on a roadway when in the lowered position and configured to empty contents of the dumpster into the collection container as the lift system carries the dumpster and moves towards the elevated position;

a mounting system coupled to the vehicle and positioned forward of a rear end of the collection container such that an individual outside the vehicle and on the roadway can access the mounting system, the mounting system comprising:

a first elongate mounting member, a second elongate mounting member, a first fastener, and a second fastener, the first fastener and the second fastener extending through the first and second elongate mounting members, respectively; and a ramp configured to be held by the mounting system, the ramp being dimensioned for placement on a curb and the roadway such that at least one wheel or caster assembly of the dumpster can travel over the ramp when the ramp is decoupled and separated from the mounting system by the individual, the ramp comprising:

a main ramp body having an upper surface and a lower surface, the upper surface and lower surface extending between a first lateral side and an opposing second lateral side of the main ramp body;

a curb mounting portion configured to rest upon an upper surface of the curb;

a roadway mounting portion configured to rest upon a surface of the roadway, the main ramp body extending between the roadway mounting portion and the curb mounting portion;

a first sidewall and a second sidewall coupled to the first and second lateral sides, respectively, the first sidewall and the second sidewall spaced laterally apart from each other;

a ramp channel defined, at least in part, by the first sidewall, the second sidewall, and the upper surface, the ramp channel dimensioned to accommodate the at least one wheel or the caster assembly of the dumpster;

at least two ramp mounting structures sized and configured to receive corresponding ones of the first elongate mounting member and the second elongate mounting member;

an installation structure for defining a first distance, the installation structure configured to be used when installing the first elongate mounting member and the second elongate mounting member such that the first elongate mounting member and the second elongate mounting member are spaced apart an installation distance substantially equal to the first distance while the first elongate mounting member and the second elongate mounting member are being coupled to the vehicle, the first distance being substantially equal to a second distance between the at least two ramp mounting structures; and wherein the first and second elongate mounting members extend away from the vehicle through the curb ramp such that the curb ramp is between the vehicle and the first and second fasteners when the curb ramp is coupled to the mounting system.

9. The system of claim 1, wherein the garbage truck is a front loading garbage truck and the lift system includes a pair of elongate lifting arms that lift the dumpster over a cabin of the garbage truck when the lift system moves from the lowered position to the elevated position.

10. The system of claim 1, wherein the lift system is adapted to rotate the dumpster towards an upside down orientation so as to empty the contents of the dumpster into the collection container.

11. The system of claim 1, wherein the mounting system is coupled to a side of the collection container.

* * * * *